US010386742B2

(12) United States Patent
Hayasaka et al.

(10) Patent No.: US 10,386,742 B2
(45) Date of Patent: Aug. 20, 2019

(54) MUFFLING MEMBER FOR IMAGE FORMING APPARATUS

(71) Applicant: FUJI XEROX CO., LTD., Tokyo (JP)

(72) Inventors: Satoshi Hayasaka, Kanagawa (JP); Hiroshi No, Kanagawa (JP); Masahiro Mori, Kanagawa (JP); Shinya Makiura, Kanagawa (JP); Shuhei Yamazaki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/823,591

(22) Filed: Nov. 28, 2017

(65) Prior Publication Data

US 2018/0267423 A1 Sep. 20, 2018

(30) Foreign Application Priority Data

Mar. 16, 2017 (JP) ..... 2017-051852

(51) Int. Cl.

| | |
|---|---|
| ***G03G 15/02*** | (2006.01) |
| ***G03G 15/00*** | (2006.01) |
| ***G03G 21/16*** | (2006.01) |

(52) U.S. Cl.

CPC ..... *G03G 15/0266* (2013.01); *G03G 15/75* (2013.01); *G03G 15/751* (2013.01); *G03G 21/1671* (2013.01)

(58) Field of Classification Search

CPC .. G03G 15/0266; G03G 15/75; G03G 15/751; G03G 21/1671

See application file for complete search history.

(56) References Cited

U.S. PATENT DOCUMENTS

| | | | | |
|---|---|---|---|---|
| 6,296,979 | B1 * | 10/2001 | Morita | G03G 5/10 399/16 |
| 6,572,801 | B2 * | 6/2003 | Litman | B29C 44/582 264/334 |
| 7,096,556 | B2 * | 8/2006 | Endo | G03G 15/0894 156/94 |
| 2016/0026143 | A1 * | 1/2016 | Ichikawa | G03G 15/751 399/159 |
| 2016/0274532 | A1 * | 9/2016 | Makiura | G03G 15/10 |

FOREIGN PATENT DOCUMENTS

| | | |
|---|---|---|
| JP | 2004077936 | 3/2004 |

* cited by examiner

*Primary Examiner* — Joseph S Wong
(74) *Attorney, Agent, or Firm* — JCIPRNET

(57) ABSTRACT

A muffling member for an image forming apparatus includes a thermoplastic member disposed in a photoconductor drum and having a substantially hollow cylindrical shape. The thermoplastic member has a slit-shaped opening at a certain position in a circumferential direction of the thermoplastic member. The thermoplastic member also has a second opening at least at a certain position along the slit-shaped opening, the second opening having an opening width greater than an opening width of the slit-shaped opening.

7 Claims, 7 Drawing Sheets

MUFFLING MEMBER FOR IMAGE FORMING APPARATUS

CROSS-REFERENCE TO RELATED APPLICATIONS

This application is based on and claims priority under 35 USC 119 from Japanese Patent Application No. 2017-051852 filed Mar. 16, 2017.

BACKGROUND (i) Technical Field

The present invention relates to a muffling member for an image forming apparatus.

(ii) Related Art

In recent years, there has been a rapid shift from mass production and mass disposal toward resource conservation and environmental restoration in the field of image forming apparatuses, such as copy machines, printers, and facsimile machines, including electrophotographic systems. To provide users with environmentally friendly products, resource-saving, environment-conscious production systems that take the entire product lifecycle from product planning, development, and manufacturing to disposal into consideration have been studied. In a resource-saving, environment-conscious production system, used products, such as copy machines and printers, are collected from the market as resource, and are disassembled into individual components. The components are subjected to, for example, screening and inspection processes, and are reused as, for example, recycled components.

SUMMARY

According to an aspect of the invention, there is provided a muffling member for an image forming apparatus including a thermoplastic member disposed in a photoconductor drum and having a substantially hollow cylindrical shape. The thermoplastic member has a slit-shaped opening at a certain position in a circumferential direction of the thermoplastic member. The thermoplastic member also has a second opening at least at a certain position along the slit-shaped opening, the second opening having an opening width greater than an opening width of the slit-shaped opening.

BRIEF DESCRIPTION OF THE DRAWINGS

An Exemplary embodiment of the present invention will be described in detail based on the following figures, wherein.

DETAILED DESCRIPTION

An exemplary embodiment of the present invention will now be described with reference to the drawings. Although a digital printer will be described as an example of an image forming apparatus, the present invention is not limited to this, and may instead be applied to any apparatus including a photoconductor drum, such as a multifunction machine.

The digital printer forms an image based on image information transmitted from, for example, a personal computer or an image reading device. The digital printer includes a printer body containing a process cartridge obtained by integrating image forming components, such as a photoconductor drum, into a unit. The process cartridge is detachably attached to the printer body. When, for example, the lifespan of the photoconductor drum included in the process cartridge expires, a cover provided on, for example, an upper section of the printer body is opened and the process cartridge is replaced with a new cartridge.

The process cartridge is constituted by an upper cartridge and a lower cartridge that are connected together, and includes a photoconductor drum that serves as an image carrier, a charging roller that serves as a charging unit, a developing device that serves as a developing unit, and a cleaning device.

The photoconductor drum is coated with, for example, an organic photoconductor (OPC), and is rotated at a predetermined rotational speed by a driving unit. A surface of the photoconductor drum is uniformly charged to a predetermined potential by a charging roller, and is subjected to image exposure by a raster output scanner (ROS) that serves as an exposure unit. Thus, an electrostatic latent image corresponding to the image information is formed on the surface of the photoconductor drum.

Figure 1A:
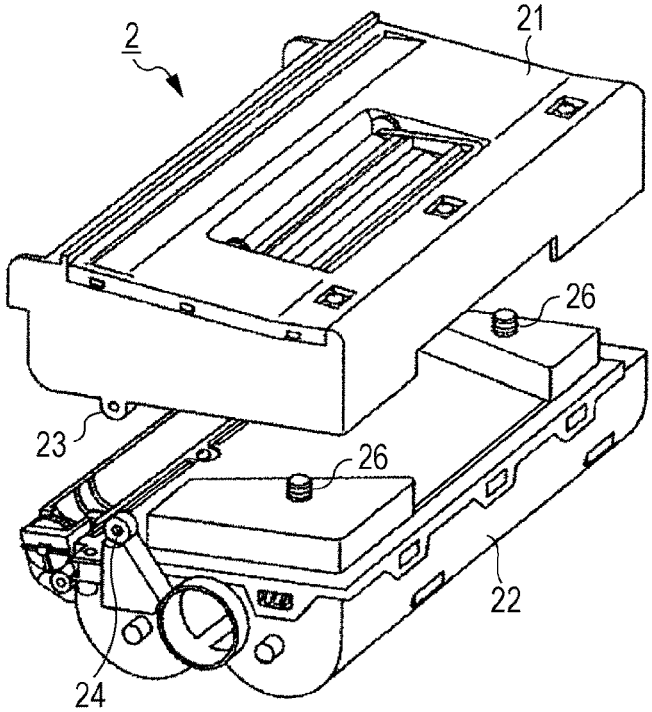
FIGS. 1A and 1B illustrate the structure of a process cartridge.
Figure 1B:
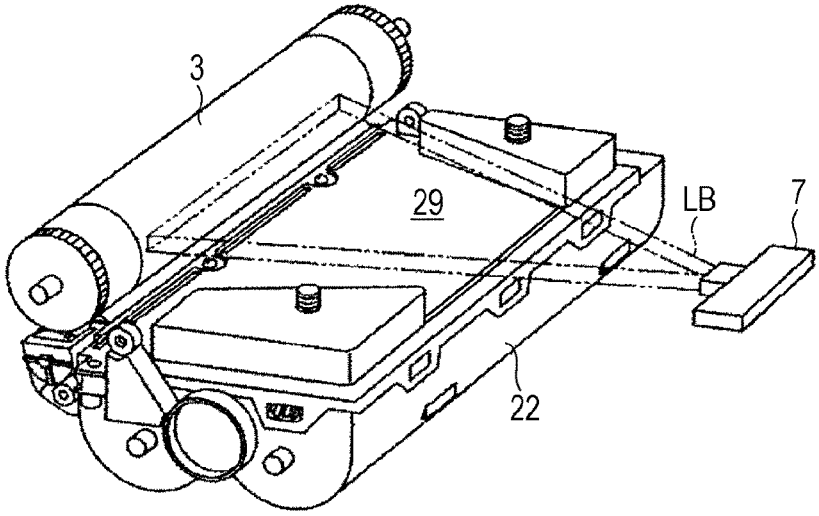

FIGS. 1A and 1B respectively illustrate the structure of a process cartridge 2 and image exposure performed on a photoconductor drum 3. The process cartridge 2 is constituted by an upper cartridge 21 and a lower cartridge 22. The upper cartridge 21 and the lower cartridge 22 include engagement portions 23 and 24 and engagement pins at both ends thereof in the width direction, and are connected to each other so as to be pivotable around the engagement pins. The upper cartridge 21 and the lower cartridge 22 are urged by springs 26 provided on the top surface of the lower cartridge 22, so that the photoconductor drum 3 is pressed against tracking rollers provided on end portions of a developing roller including in a developing device at a predetermined pressure.

The photoconductor drum 3 is rotatably attached to one end portion of the upper cartridge 21. A charging roller is disposed on one side of the photoconductor drum 3, and a cleaning blade of a cleaning device is disposed above the photoconductor drum 3. A cover that covers a surface of the photoconductor drum 3 is provided on the upper cartridge 21 so that the cover may be opened and closed. The cover normally covers the surface of the photoconductor drum 3 to prevent degradation of the photoconductor drum 3 due to exposure to light. When the process cartridge is attached to the printer body at a predetermined position, the cover automatically opens in response to the attachment of the process cartridge. Then, the photoconductor drum 3 and a transfer roller come into contact with each other.

A ROS 7 modulates a semiconductor laser based on image information subjected to a predetermined image process by an image processing device, and scans the photoconductor drum 3 with a laser beam LB emitted from the semiconductor laser through an imaging optical system including a collimator lens, a reflecting mirror, a polygon mirror, and an f-θ lens. Thus, an electrostatic latent image is formed on the surface of the photoconductor drum 3. In FIGS. 1A and 1B, a substantially fan-shaped radiation space 29 is provided on the top surface of the lower cartridge 22 of the process cartridge. The laser beam LB is radiated through the radiation space 29. The electrostatic latent image formed on the photoconductor drum 3 is developed into a toner image by a developing device containing developer (toner).

The toner image formed on the photoconductor drum 3 is transferred onto a recording paper sheet, which serves as a recording medium, by a transfer roller, which serves as a transfer unit. The recording paper sheet is fed from a paper feed cassette by a feed roller, separated from other recording paper sheets by a separation roller and a retard roller, and transported to a registration roller, which temporarily stops the recording paper sheet. Then, the registration roller transports the recording paper sheet to the surface of the photoconductor drum 3 in synchronization with the toner image formed on the photoconductor drum 3. The toner image is transferred from the photoconductor drum 3 to the recording paper sheet by the transfer roller.

The recording paper sheet to which the toner image has been transferred is separated from the photoconductor drum 3, and is then transported to a fixing device. The fixing device includes a heating roller and a pressing roller that fix the toner image to the recording paper sheet by applying heat and pressure. Then, the recording paper sheet is discharged to a paper output tray provided on an upper section of the printer body by a discharge roller. Thus, an image forming operation is finished.

Residual toner that remains on the surface of the photoconductor drum 3 after the toner image has been transferred is removed by the cleaning device. Then, the photoconductor drum 3 waits for the next image forming operation.

The photoconductor drum 3 is formed by coating a surface of a thin cylindrical drum made of a metal, such as aluminum, with an organic photoconductor (OPC) or the like. A rear flange member, which is integrated with a gear for rotating the photoconductor drum 3, is press-fitted (press-fitted and bonded as necessary) to one end portion the photoconductor drum 3. A front flange member, which is integrated with a gear for rotating the developing roller of the developing device, is press-fitted to the other end portion of the photoconductor drum 3.

Figure 2A:
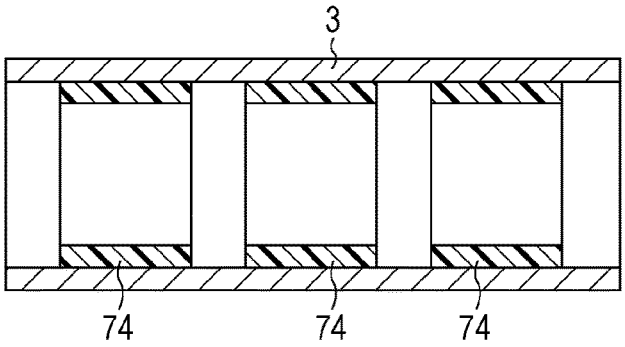
FIGS. 2A to 2C illustrate the structure of muffling members.
Figure 2B:
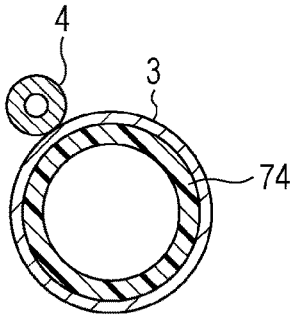
Figure 2C:
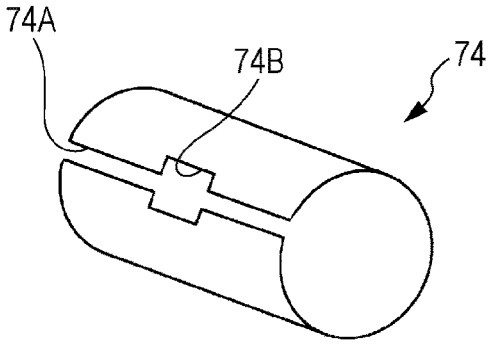

FIGS. 2A to 2C illustrate the structure of the photoconductor drum 3. As illustrated in FIGS. 2A and 2B, three muffling members 74 (thermoplastic resin members) for an electrophotographic photoconductor are fixed to the inner periphery of the photoconductor drum 3 so as to be arranged in in an axial direction. The muffling members 74 are made of a thermoplastic resin, and are provided to increase the inertial mass of the photoconductor drum 3 and to thereby reduce the noise generated when an alternating-current voltage is applied to the charging roller 4 to uniformly charge the surface of the photoconductor drum 3 with the charging roller 4. Each muffling member 74 has a hollow cylindrical or substantially hollow cylindrical shape, and has an opening 74A having an opening width of 0.5 mm or more at a certain position in the circumferential direction in an annular cross section thereof, so that the muffling member 74 may be easily inserted into and removed from the photoconductor drum 3, and so that the muffling member 74 may be tightly fixed to the photoconductor drum 3. Each muffling member 74 has an outer diameter such that a portion thereof having a general wall thickness may be brought into contact with the inner peripheral surface of the photoconductor drum 3 without a gap therebetween when attached to the inner peripheral surface of the photoconductor drum 3. The muffling members 74 are formed of a thermoplastic resin, such as ABS resin or polyvinyl chloride resin. In the exemplary embodiment, the muffling members 74 are made of ABS resin. However, the muffling members 74 may instead be made of other thermoplastic resins.

According to the related art, when an image forming apparatus is collected and muffling members 74 are removed therefrom, each muffling member 74 is subjected to heat treatment after a correcting jig is inserted into a slit-shaped opening 74A formed therein. However, there is a possibility that the axis of the correcting jig will be misaligned from the axial center of the muffling member 74 (axial misalignment may occur) when the correcting jig is inserted into the opening 74A. When the heat treatment is performed without correcting the axial misalignment, there is a risk that the desired opening width cannot be obtained.

Accordingly, in the present exemplary embodiment, as illustrated in FIG. 2C, each muffling member 74 has a second opening 74B having a rectangular or substantially rectangular shape in addition to the slit-shaped opening 74A, which is formed at a certain position in the circumferential direction in an annular cross section of the muffling member 74 having a hollow cylindrical or substantially hollow cylindrical shape. The second opening 74B is provided at a predetermined position along the slit-shaped opening 74A (at substantially the center of the opening 74A in the illustrated example), and has an opening width greater than that of the opening 74A. The opening width of the second opening 74B is not particularly limited as long as the opening width of the second opening 74B is greater than that of the opening 74A. The opening width of the second opening 74B may be about twice the opening width of the opening 74A. For example, the opening width of the opening 74A may be 2.60 mm, and the opening width of the second opening 74B may be 5.00 mm. When the muffling member 74 is recycled, heat treatment is performed after inserting a correcting jig not only through the opening 74A but also through the second opening 74B.

Figure 3:
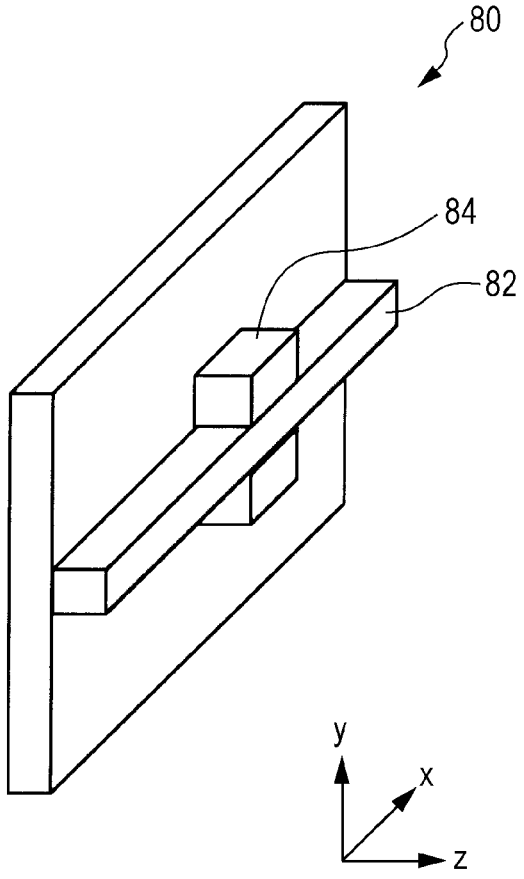
FIG. 3 illustrates the structure of a correcting jig.

FIG. 3 is a perspective view of a correcting jig 80 used to recycle the muffling member 74. The correcting jig 80 has a projection 82 to be inserted into the slit-shaped opening 74A and a projection 84 to be inserted into the second opening 74B at one side thereof. In FIG. 3, the projections 82 and 84 have the same height. In other words, the projections 82 and 84 project from the principal surface of the correcting jig 80 by the same amount. However, the projections 82 and 84 may instead have different heights and project by different amounts. When x, y, and z directions that are perpendicular to each other are defined as shown in FIG. 3, the dimension of the projection 82 in the y direction corresponds to the opening width of the opening 74A, and the total dimension of the two projections 82 and 84 in the y direction corresponds to the opening width of the second opening 74B. The projections 82 and 84 have the same dimension in the z direction. In other words, the projections 82 and 84 project by the same amount. Alternatively, however, the dimension of the projection 82 in the z direction may be, for example, greater than the dimension of the projection 84 in the z direction.

Figure 4A:
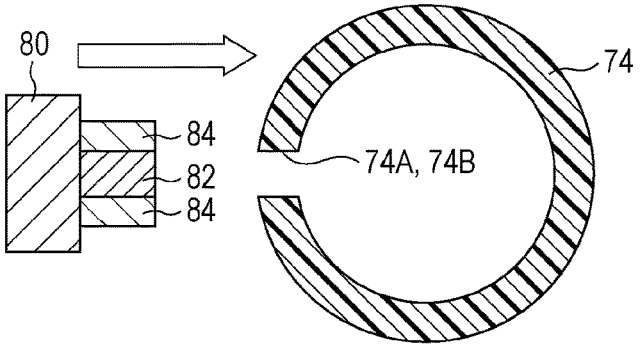
FIGS. 4A and 4B illustrate the manner in which the correcting jig is inserted.
Figure 4B:
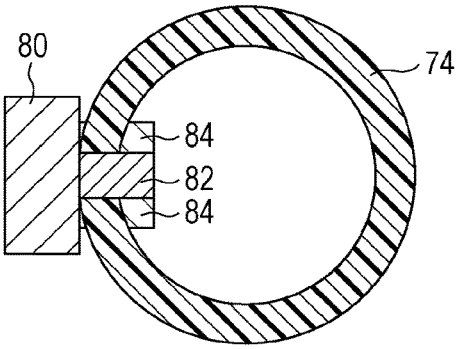

FIGS. 4A and 4B illustrate the manner in which the correcting jig 80 is inserted into the muffling member 74 when the muffling member 74 is recycled. The muffling member 74 and the correcting jig 80 are positioned so that the opening 74A in the muffling member 74 and the projection 82 on the correcting jig 80 face each other and that the second opening 74B in the muffling member 74 and the projection 84 on the correcting jig 80 face each other. Then, one of the muffling member 74 and the correcting jig 80 is moved relative to the other. For example, the correcting jig 80 is moved relative to the muffling member 74 to insert the projection 82 into the opening 74A and the projection 84 into the second opening 74B.

Figure 5:
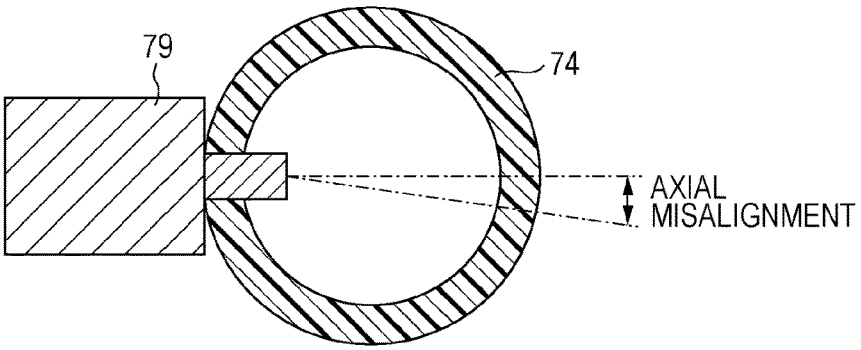
FIG. 5 RELATED ART
FIG. 5 illustrates the manner in which a correcting jig according to the related art is inserted.

FIG. 5 illustrates the manner in which a correcting jig 79 is inserted into a muffling member 74 according to the related art which only has a slit-shaped opening 74A. The correcting jig 79 has a projection corresponding to the projection 82, but not has a projection corresponding to the projection 84. Therefore, when the correcting jig 79 is inserted into the muffling member 74, as illustrated in FIG. 5, the axis of the correcting jig 79 may be misaligned from the axial center of the muffling member 74. In contrast, according to the present exemplary embodiment, the muffling member 74 has the second opening 74B in addition to the opening 74A, and therefore comes into contact with the correcting jig 80 over a larger area. Accordingly, the axes of the muffling member 74 and the correcting jig 80 may be more easily aligned, and the axial misalignment therebetween may be reduced.

Figure 6:
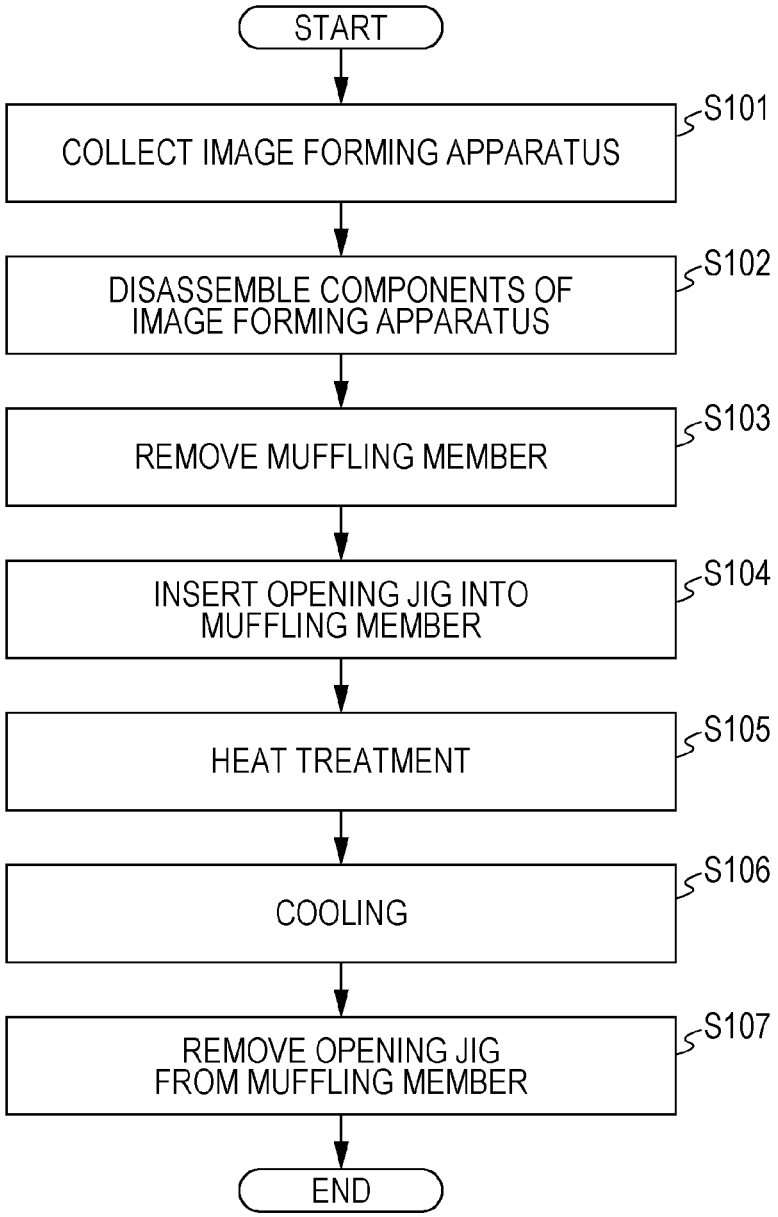
FIG. 6 is a process flowchart according to an exemplary embodiment.

FIG. 6 is a flowchart of a process for recycling the muffling member 74 (recycling process) according to the present exemplary embodiment.

When a digital printer, which serves as an image forming apparatus, is collected, the collected digital printer is transported to a recycling facility (S101).

Next, the digital printer is disassembled in the recycling facility. Then, the process cartridge, which is a component of the image forming apparatus, is further disassembled into individual components including the photoconductor drum 3 (S102).

Next, the muffling member 74 is removed from the photoconductor drum 3 (S103). The muffling member 74 may be removed either automatically by using a removing device or manually by an operator. The removed muffling member 74 is set to an air cleaning machine and is air-cleaned.

Next, the correcting jig 80 (opening jig) is inserted into the muffling member 74 (S104) and heat treatment is performed (S105). More specifically, a preheating step is performed in which the correcting jig 80 to which the muffling member 74 is attached is immersed in hot water in a constant temperature bath for a predetermined time. In the case where the muffling member 74 is made of ABS resin, the preheating step is performed at a temperature of 25° C. for a time corresponding to the process time of the heat treatment step (for example, 10±0.5 minutes). In the case where the muffling member 74 is made of polyvinyl chloride resin, the preheating step is performed at a temperature of 25° C. for a time corresponding to the process time of the heat treatment step (for example, 10±0.5 minutes). The process time of the preheating step may be different from that of the heat treatment step and may be, for example, about 12 minutes.

After the preheating step, the muffling member 74 is subjected to a heat treatment (annealing) step. In the heat treatment step, the correcting jig 80 to which the muffling member 74 is attached is pulled up from the constant temperature bath for the preheating step. Then, similar to the preheating step, the correcting jig 80 to which the muffling member 74 is attached is immersed in hot water in a constant temperature bath for the heat treatment step for a predetermined time. In the case where the muffling member 74 is made of ABS resin, the heat treatment is performed by immersing the correcting jig 80 to which the muffling member 74 is attached in the hot water in the constant temperature bath at a temperature of 68±1° C. for 10±0.5 minutes. In the case where the muffling member 74 is made of polyvinyl chloride resin, the heat treatment is performed by immersing the correcting jig 80 to which the muffling member 74 is attached in the hot water in the constant temperature bath at a temperature of 65±1° C. for 10±0.5 minutes. The temperature in the heat treatment step is set so as to be lower than or equal to the heat deflection temperature of the thermoplastic resin that forms the muffling member 74. The heat treatment step enables the muffling member 74 that has been used and deformed to return to the predetermined original shape.

Next, a cooling step is performed (S106). In this step, the muffling member 74 attached to the correcting jig 80 is immersed in tap water. Then, the correcting jig (opening jig) 80 is removed from the muffling member 74 so that the muffling member 74 may be reused (S107).

Before the muffling member 74 is reused, a mark indicating that the muffling member 74 is a recycled product is put on the muffling member 74 at a predetermined position. Then, the opening width of the slit-shaped opening 74A is measured with, for example, a gauge to check whether or not the opening width is within a predetermined standard range.

Thus, in the present exemplary embodiment, the muffling member 74 has the second opening 74B in addition to the opening 74A. Accordingly, the axial misalignment of the correcting jig (opening jig) 80 is reduced and heat treatment for restoring the muffling member 74 is facilitated. As a result, a reduction in the recycling rate may be inhibited.

The muffling member 74 has a hollow cylindrical or substantially hollow cylindrical shape, and therefore a die used to form the muffling member 74 by injection molding needs to have a sliding structure. Since the muffling member 74 has the second opening 74B, the muffling member 74 may be prevented from being displaced when it is slid out in the injection molding process.

Although an exemplary embodiment of the present invention has been described, the present invention is not limited to this, and various modifications are possible. Modifications will now be described.

First Modification

In the exemplary embodiment, as illustrated in FIGS. 4A and 4B and other figures, the muffling member 74 has the slit-shaped opening 74A, which is provided at a certain position in the circumferential direction in an annular cross section of the muffling member 74 having a hollow cylindrical or substantially hollow cylindrical shape, and also has the rectangular second opening 74B, which is formed at a predetermined position along the slit-shaped opening 74A (at substantially the center of the opening 74A), and which has an opening width greater than that of the opening 74A. The muffling member 74 may further include a hinge portion.

Figure 7A:
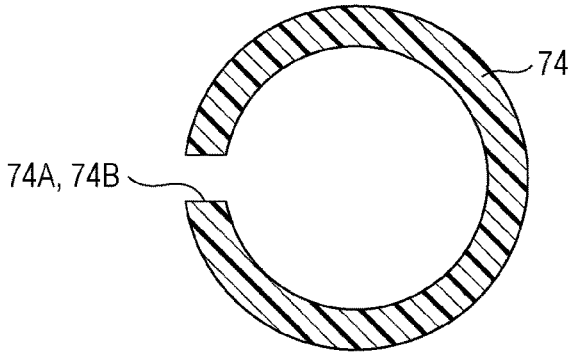
FIGS. 7A to 7C are sectional views of muffling members according to modifications.
Figure 7B:
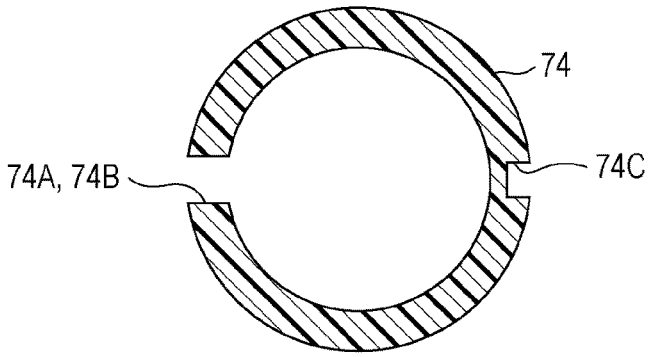
Figure 7C:
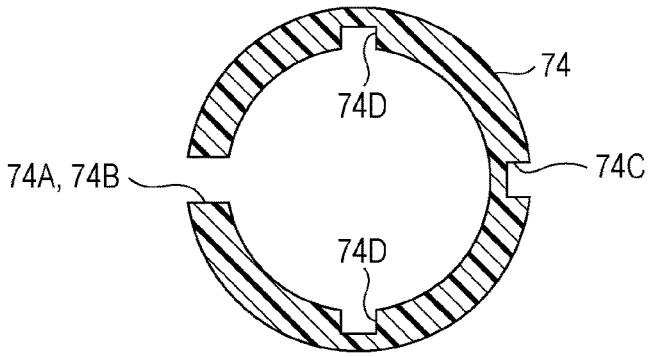

FIGS. 7A to 7C are sectional views of muffling members 74. FIG. 7A is a sectional view of the exemplary embodiment. FIGS. 7B and 7C are sectional views of modifications. In FIG. 7B, a hinge portion 74C is formed at a position where the hinge portion 74C opposes the opening 74A and the second opening 74B. In FIG. 7C, hinge portions 74D are formed in addition to the hinge portion 74C, and a total of three hinge portions are provided. The angles between the position of the opening 74A and the second opening 74B, the position of the hinge portion 74C, and the positions of the hinge portions 74D are 90° in cross section. The hinge portions enable the muffling members 74 to be reliably attached to the inner peripheral surface of the photoconductor drum 3.

Second Modification

In the exemplary embodiment, the second opening 74B has a rectangular or substantially rectangular shape in plan view. However, the second opening 74B may instead have a circular shape, a square shape, a star shape, etc., in plan view. The shape may be such that the second opening 74B and the correcting jig come into contact with each other over a large area and that the second opening 74B may be easily formed. In this respect, the second opening 74B may have a rectangular or substantially rectangular shape.

Third Modification

In the exemplary embodiment, a single second opening 74B is provided at substantially the center of the slit-shaped opening 74A. However, the number and position of second openings 74B are not limited. When a single second opening 74B is provided at substantially the center, the muffling member 74 receives a uniform stress when the correcting jig 80 is inserted, and the axial misalignment may be further reduced.

Figure 8:
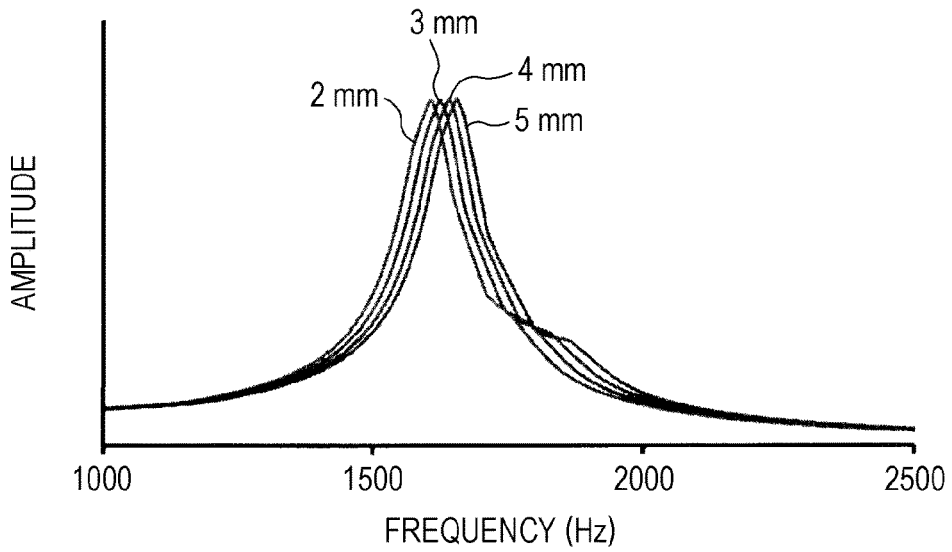
FIG. 8 is a graph showing the result of simulation according to a modification.

When the second opening 74B is formed, the resonant frequency of the muffling member 74 is shifted from that in the case where the second opening 74B is not formed. The position and shape of the second opening 74B may be determined so as to increase the muffling effect in consideration of the shift in the resonant frequency. The change in the resonant frequency and the muffling performance obtained when the position and shape of the second opening 74B are changed may be simulated, and the position and shape of the second opening 74B may be optimized based on the result of the simulation. FIG. 8 is a graph showing the result of the simulation performed by a computer. The graph shows the changes in the resonant frequency of the muffling member 74 in the case where the width of the second opening 74B, that is, the dimension of the second opening 74B in the longitudinal direction of the muffling member 74 in FIG. 2C, is changed. The horizontal axis represents the frequency (Hz), and the vertical axis represents the amplitude. The graph shows the changes in the resonant frequency in the cases where the width of the second opening 74B is set to 2 mm, 3 mm, 4 mm, and 5 mm. As is clear from the graph, the resonant frequency, that is, the frequency corresponding to the maximum amplitude, is gradually shifted as the width of the second opening 74B increases. Thus, the resonant frequency may be shifted by adjusting the width of the second opening 74B, and the muffling effect may be increased by reducing the amplitude of the muffling member 74 at a desired frequency. This means that the second opening 74B not only reduces the axial misalignment in the recycling process but also increases the muffling performance.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A muffling member for an image forming apparatus, comprising:

a thermoplastic member disposed in a photoconductor drum and having a substantially hollow cylindrical shape, wherein the thermoplastic member has an inner surface and an outer surface opposite to the inner surface, wherein the thermoplastic member has a slit-shaped opening at a certain position in a circumferential direction of the thermoplastic member, and wherein the thermoplastic member also has a second through opening at least at a certain position along the slit-shaped opening, the second through opening has an opening width greater than an opening width of the slit-shaped opening, and an entirety of the second through opening extends from the inner surface to the outer surface.

2. The muffling member according to claim 1, wherein the second through opening is formed at substantially the center of the slit-shaped opening.

3. The muffling member according to claim 1, wherein the second through opening has a substantially rectangular shape in plan view.

4. The muffling member according to claim 2, wherein a hinge portion is provided at least at a position where the hinge portion opposes the slit-shaped opening and the second through opening in the circumferential direction.

5. The muffling member according to claim 3, wherein a hinge portion is provided at least at a position where the hinge portion opposes the slit-shaped opening and the second through opening in the circumferential direction.

6. The muffling member according to claim 4, wherein the hinge portion is provided at each of three positions in the circumferential direction.

7. The muffling member according to claim 5, wherein the hinge portion is provided at each of three positions in the circumferential direction.

* * * * *